US005264681A

United States Patent [19]

Nozaki et al.

[11] Patent Number: 5,264,681

[45] Date of Patent: Nov. 23, 1993

[54] CERAMIC HEATER

[75] Inventors: Shunkichi Nozaki; Yasuhiko Suzuki; Kazuho Tatematsu; Masakazu Iwai; Kiminori Horiki, all of Aichi, Japan

[73] Assignee: NGK Spark Plug Co., Ltd., Nagoya, Japan

[21] Appl. No.: 832,315

[22] Filed: Feb. 7, 1992

[30] Foreign Application Priority Data

Feb. 14, 1991 [JP] Japan ..... 3-020787
Mar. 13, 1991 [JP] Japan ..... 3-048339

[51] Int. Cl.[5] ..... H05B 3/44; H05B 3/50; H05B 3/10

[52] U.S. Cl. ..... 219/544; 219/553; 219/270

[58] Field of Search ..... 219/552, 270, 544, 546, 219/548, 553; 338/327; 123/145 A, 145 R; 361/264; 431/191, 209, 258, 262, 263

[56] References Cited

U.S. PATENT DOCUMENTS 4,786,781 11/1988 Nozaki et al. ..... 219/270
4,804,823 2/1989 Okuda et al. ..... 219/553
4,912,305 3/1990 Tatemasu et al. ..... 219/544
4,963,717 10/1990 Woelfle ..... 219/270

FOREIGN PATENT DOCUMENTS 63-81787 4/1988 Japan .
63-88777 4/1988 Japan .
2-183718 7/1990 Japan .

*Primary Examiner*—Bruce A. Reynolds
*Assistant Examiner*—Michael D. Switzer
*Attorney, Agent, or Firm*—Foley & Lardner

[57] ABSTRACT

The invention relates to a ceramic heater for use, e.g., as a glow plug for a diesel engine or as an igniter for an oil or gas burner. The ceramic heater has a nonoxide ceramic body having a heating part and a supporting part and a heating resistor embedded in the heating part of the ceramic body. The material of the heating resistor is W, WC, tungsten alloy or a metal nitride such as TiN or TaN. According to the invention the heating part of the ceramic body is formed of aluminum nitride ceramic, which is high in heat conductivity and resistant to oxidation at high temperatures, at least in a core region in contact with the heating resistor, and the supporting part is formed of silicon nitride ceramic which is low in heat conductivity at least in a surface region. The ceramic body is made by uniting a heating part entirely formed of aluminum nitride ceramic and a supporting part entirely formed of silicon nitride ceramic with interposal of a joint part which is formed of mixed ceramic of aluminum nitride and silicon nitride with a gradient of the proportion of aluminum nitride to silicon nitride, or by thoroughly covering a core formed of aluminum nitride ceramic with silicon nitride ceramic.

27 Claims, 7 Drawing Sheets

CERAMIC HEATER

BACKGROUND OF THE INVENTION

This invention relates to a ceramic heater which essentially consists of a sintered body of a nonoxide ceramic and a heating resistor which is embedded in the ceramic body as a heating element. The ceramic heater is used, for example, as a glow plug for a diesel engine or as an igniter for a gas or oil burner.

In conventional ceramic heaters the nonoxide ceramic body is usually formed of a silicon nitride ($Si_3N_4$) based ceramic or an aluminum nitride (AlN) based ceramic. The material of the heating resistor is either a metal represented by tungsten and its alloys or a metal compound such as tungsten carbide (WC), titanium nitride or tantalum nitride. In the case of a metal resistor a coiled wire is often used. In the case of a metal compound resistor it is usual to form a so-called thick-film by a printing and firing process using a paste containing a powder of the resistor material.

As to known ceramic heaters, for example, JP 2-183718 A shows a glow plug having a heating resistor of tungsten in an aluminum nitride ceramic body which is coated with a silicon carbide film; JP 63-88777 A shows a ceramic heater having a WC based heating resistor in a silicon nitride or aluminum nitride based ceramic body; and JP 63-81787 A shows a ceramic heater having a TiN based heating resistor in an aluminum nitride based ceramic body.

Silicon nitride based ceramic is relatively low in heat conductivity (about 17 W/mK). Therefore, when the heating resistor in a heater body formed of this ceramic is energized a relatively long time runs before the surface temperature of the heating part reaches a sufficiently high level. Besides, in practical use of the heater it is necessary to keep the temperature of the silicon nitride based ceramic body below 1300° C. If the temperature of the ceramic body exceeds 1300° C. by the deliver of heat from the heating resistor or from a high temperature atmosphere in which the heater is used, the ceramic body is seriously and rapidly oxidized from the surface. Even in the air the progress of the oxidation of the ceramic body often results in oxidation and breakage of the heating resistor. In the case of a glow plug used in an engine the ceramic body becomes thin by erosion.

In a silicon nitride based ceramic there is a grain boundary phase which has a relatively low melting point (about 1400° C.). When the heating resistor in the body of silicon nitride based ceramic is made of tungsten, tungsten alloy or tungsten carbide and kept energized for a long time until the temperature in the vicinity of the resistor nears 1500° C., a reaction takes place between tungsten and the aforementioned grain boundary phase to form tungsten silicide $WSi_2$ in the surface region of the resistor. As a result the heating resistor increases its resistance and becomes locally unconductive in an extreme case.

When the heating resistor in the body of silicon nitride based ceramic is made of a metal nitride such as TiN or TaN, there is a possibility that a fraction of the silicon nitride based ceramic undergoes electrolytic decomposition since an electrical potential difference occurs between the positive side and the negative side of the metal nitride resistor. If such decomposition occurs pores will appear in the ceramic body as a cause of lowering of the mechanical strength of the ceramic body, and the heating resistor might become locally unconductive.

Aluminum nitride based ceramic is relatively high in heat conductivity (about 170 W/mK). As the material of the body of a ceramic heater this property is favorable for a rapid rise in the temperature of the surface of the heating part of the heater body. However, in this case there arises a different problem. Usually a part of the ceramic body is used as a supporting part by not embedding the heating resistor in that part, and electrical terminals of the ceramic heater and external leads are connected in the supporting part. When the ceramic heater having an aluminum nitride based ceramic body is operated so as to keep the temperature of the heating part about 1300° C. or above the temperature of the supporting part of the ceramic body rises up to about 800° C. in a short time. Therefore there is a possibility of oxidation of the soldered connections of the electrical terminals and resultant degradation of the electrical connection. Besides, the high heat conductivity of the ceramic body causes easy liberation of heat from the supporting part of the ceramic body, whereby the power consumption of the heater increases.

SUMMARY OF THE INVENTION

It is an object of the present invention to provide a ceramic heater which is high in the rate of a rise in the temperature of the heating part, excellent in the resistance to oxidation at high temperatures, low in the temperature of the supporting part during operation of the heater and low in power consumption.

The present invention provides a ceramic heater having a sintered nonoxide ceramic body, which has a heating part and a supporting part, and a heating resistor which is embedded in the heating part of the ceramic body. According to the invention, the heating part of the ceramic body is formed of an aluminum nitride based ceramic at least in a core region thereof which is in contact with and encloses the heating element, and the supporting part is formed of a silicon nitride based ceramic at least in a surface region thereof.

In the ceramic body of a heater according to the invention the heating part is formed of an AlN based ceramic either wholly or only in a core region enclosing therein the heating resistor. In the latter case it is optional to cover the core region with a surface region which is formed of a $Si_3N_4$ based ceramic. The supporting part of the ceramic body is formed of a $Si_3N_4$ based ceramic either wholly or only in a surface region. In the latter case a core region of the supporting part is contiguous to the core region of the heating part and formed of an AlN based ceramic.

In the ceramic body according to the invention it is optional, and rather preferable, to interpose a joint part, which is formed of a mixed ceramic containing both AlN and $Si_3N_4$ with a gradient of the proportion of AlN to $Si_3N_4$, between the part or region formed of the AlN based ceramic and the part or region formed of the $Si_3N_4$ based ceramic in order to firmly and durably join the two kinds of ceramics which have different thermal expansion coefficients.

In a ceramic heater according to the invention the principal material of the heating resistor is selected from tungsten, tungsten alloys, tungsten carbide (WC) and metal nitrides such as TiN and TaN. The form of the heating resistor is not limited: it may be a coiled or uncoiled wire, a ribbon, a film or sheet. In the case of a film resistor, it may be a so-called thick film formed by a printing and firing process using a conductive paste containing a powder of the resistor material.

In operation of a ceramic heater according to the invention the surface temperature of the heating part rapidly rises to a desired high temperature since an aluminum nitride based ceramic, which is high in heat conductivity, is used as the main material of the heating part. The heating resistor is enclosed in an AlN based ceramic which is excellent in resistance to oxidation at high temperatures, whereby the heating resistor is protected from oxidation and resultant breakage. On the other hand, the temperature of the supporting part remains relatively low since a $Si_3N_4$ based ceramic, which is low in heat conductivity, is used as the main material of the supporting part. Accordingly, soldered connections of the electrical terminals of the heater remain at relatively low temperatures and hence do not break or deteriorate even though the temperature of the heating part becomes high. Besides, the low heat conductivity of the $Si_3N_4$ based ceramic in the supporting part has the effect of decreasing a loss of the heat generated by the heating resistor through the supporting part, and hence the heater is relatively low in power consumption.

In a ceramic heater according to the invention the heating resistor is in contact with and enclosed in an AlN based ceramic without making contact with a $Si_3N_4$ based ceramic. Therefore, there is practically no problem in using any of the above named resistor materials. When tungsten, a tungsten alloy or tungsten carbide is used, the resistor remains chemically stable and does not increase its resistivity even though the resistor remains at high temperatures since the AlN based ceramic contains little grain boundary phase and is free of Si. Even when a metal nitride such as TiN or TaN is used, there is no possibility of electrolysis of the AlN based ceramic in contact with the nitride resistor. That is, the existence of a nitride resistor does not cause lowering of the mechanical strength of the surrounding AlN based ceramic or appearance of pores in the ceramic, and hence the resistor itself is hardly deteriorated or damaged.

A ceramic heater according to the invention is suitable for use, for example, in a glow plug for a diesel engine, as an igniter for an oil or gas burner or as a heater for vaporizing kerosene in a fanned kerosene stove.

DESCRIPTION OF THE PREFERRED EMBODIMENTS

A ceramic heater according to the invention is produced by sintering a green body of the ceramic material in which a heating resistor is embedded in advance. Usually the green body is an assembly of two parts, and the heating resistor is disposed on a surface of one green part which comes into contact with an opposite surface of the other green part.

Figure 1:
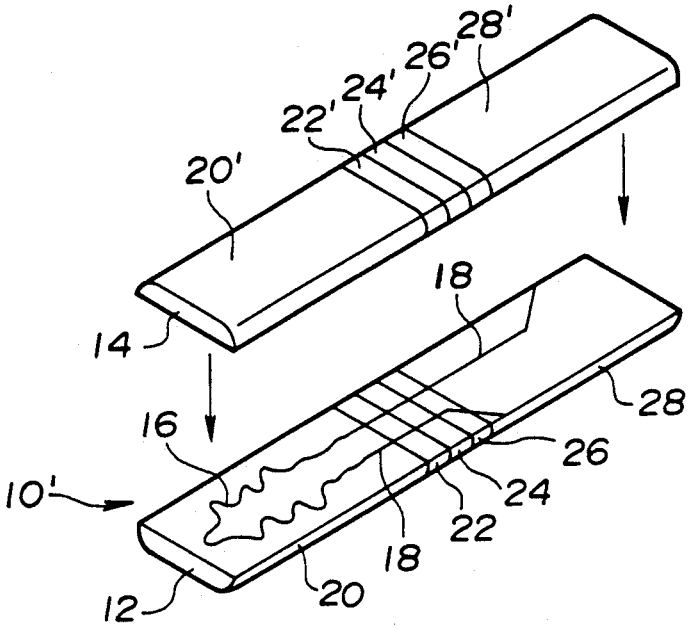
FIG. 1 is a exploded perspective view of a ceramic heater as a first example of the invention in green state before sintering.
Figure 2:
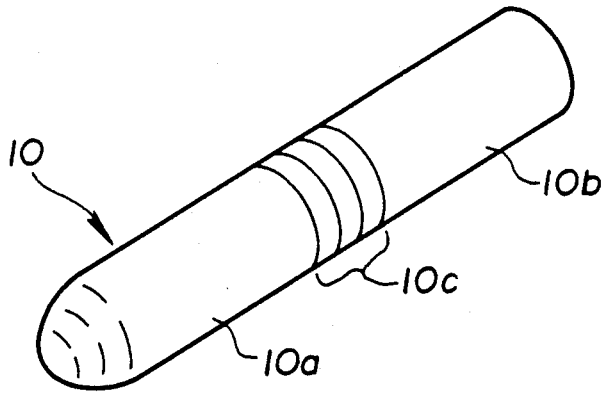
FIG. 2 is a perspective view of the finished ceramic heater of the first example.

As a first embodiment of the invention FIGS. 1 and 2 show a ceramic heater 10 for use in a glow plug. The ceramic heater 10 has an elongate shape, and, as indicated in FIG. 2, the ceramic body of the heater 10 consists of a heating part 10*a* which includes one end of the elongate body, a supporting part 10*b* which includes the opposite end of the elongate body and a joint part 10*c* interposed between the heating and supporting parts 10*a* and 10*b*. The heating part 10*a* of the ceramic body is formed of an AlN based ceramic, and the supporting part 10*b* is formed of a $Si_3N_4$ based ceramic. The joint part 10*c* is formed of mixed ceramics containing both AlN and $Si_3N_4$.

FIG. 1 illustrates a green body 10' to be sintered to obtain the ceramic heater 10 of FIG. 2. The green body 10' is an assembly of two green plates 12 and 14. The details of these green plates 12, 14 will be described hereinafter. A heating resistor 16 and lead wires 18 are placed on the top surface of the green plate 12. In this embodiment the heating resistor 16 is a coiled thin wire of W or a tungsten alloy such as WRe. Then the other green plate 14 is placed on the green plate 12, and the two green plates 12 and 14 are united by pressing. The resultant green body 10' is heated in a nonoxidizing atmosphere at an adequate temperature to remove an organic binder from the green body. After that the green body 10' is sintered in a nonoxidizing atmosphere usually by a hot press sintering method.

The sintered ceramic body of the heater 10 is machined to round the side surface and expose terminal portions of the lead wires 18, and also to finish the tip end portion of the heating part 10*a* into a semispherical shape for the purpose of uniforming the distribution of temperature in the tip end portion.

Figure 3:
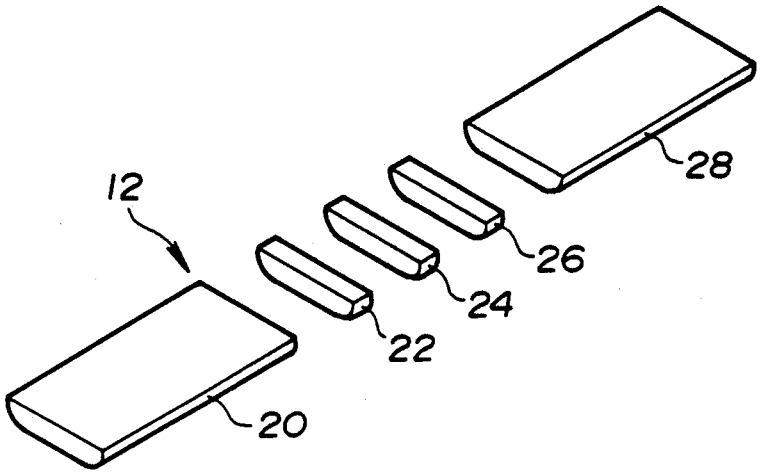
FIG. 3 is an exploded perspective view of a half of the green body shown in FIG. 1.
Figure 4:
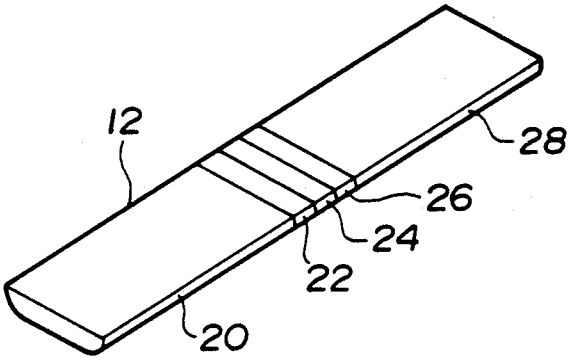
FIG. 4 is a perspective view of a half of the green body shown in FIG. 1.
Figure 5:
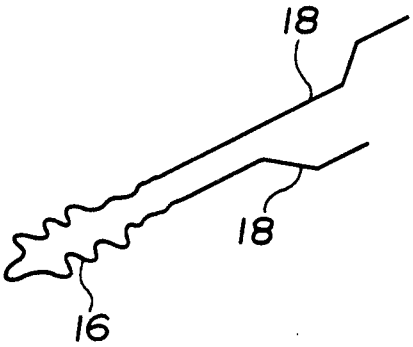
FIG. 5 is a perspective view of a heating resistor used in the ceramic heater of the first example.

The green plate 12 is an assembly of a first major segment 20 which is formed of an AlN based ceramic material and becomes a half portion of the heating part 10*a* of the ceramic heater body, a second major segment 28 which is formed of a $Si_3N_4$ based ceramic material and becomes a half portion of the supporting part 10*b* of the ceramic heater body and three juxtaposed small segments 22, 24, 26 which become a half portion of the joint part 10*c* of the ceramic heater body. Each of these three segments 22, 24, 26 is formed of a ceramic material containing both AlN and $Si_3N_4$, but the three segments 22, 24, 26 differ from each other in the proportion of AlN to $Si_3N_4$. The proportion of AlN to $Si_3N_4$ is highest in the segment 22 which is adjacent to the major segment 20 formed of AlN, lowest in the segment 26 which is adjacent to the major segment 28 formed of $Si_3N_4$ and intermediate in the middle segment 24. As shown in FIG. 3 the five segments 20, 22, 24, 26, 28 of the green plate 12 are formed separately, and these five segments are united into the green plate 12, as shown in FIG. 4, by press molding. After that the heating resistor 16, viz. coiled wire 16 in the shape shown in FIG. 5 by way of example, is placed on the first major segment 20 of the green plate 12. The lead wires 18, which are connected to the resistor 16 in advance, extend on the surfaces of the remaining segments 22, 24, 26, 28.

Symmetrically, the opposite green plate 14 is an assembly of a first major segment 20' formed of the AlN based ceramic material, a second major segment 28' formed of the $Si_3N_4$ based ceramic material and three juxtaposed small segments 22', 24', 26' formed of the ceramic materials containing AlN and $Si_3N_4$ in the different proportions described with respect to the three segments 22, 24, 26 of the green plate 12.

In the sintered ceramic heater 10 the heating resistor 16 is embedded in the heating part 10*a* formed of the AlN based ceramic without making direct contact with the supporting part 10*b* formed of the $Si_3N_4$ based ceramic. In the joint part 10*c* there is a gradient of the proportion of AlN to $Si_3N_4$, i.e. a gradual decrease from the heating part 10*a* toward the supporting part 10*b*, since three differently composed ceramic materials are used to form the joint part of the green body 10', viz. segments 22, 24, 26 of the plate 12 and segments 22', 24', 26' of the plate 14. Therefore, the joint between the heating part 10*a* formed of the AlN based ceramic and the supporting part 10*b* formed of the $Si_3N_4$ based ceramic is firm and durable despite the difference between AlN and $Si_3N_4$ in thermal expansion coefficients.

EXAMPLE 1

A ceramic heater of the type shown in FIGS. 1 and 2 was produced by the following process.

As the raw material of an aluminum nitride based ceramic, 100 parts by weight of AlN powder having a mean particle size of about 1.0 μm was mixed with 2 parts by weight of $Y_2O_3$ powder having a mean particle size of about 1.0 μm and 3 parts by weight of wax which was employed as a binder. The mixing was carried out in ethyl alcohol for 4 hr. The resultant slurry was granulated by spray drying. The obtained granular material, which will be called the first material, was about 60 μm in mean grain size and exhibited good fluidity. The granular first material was molded to form the first segment 20 of the green plate 12 and the first segment 20' of the green plate 14.

As the material of a silicon nitride based ceramic, 100 parts by weight of $Si_3N_4$ powder having a mean particle size of about 1.0 μm was mixed with 3 parts by-weight of the aforementioned $Y_2O_3$ powder, 3 parts by weight of $Al_2O_3$ powder having a mean particle size of about 1.0 μm and 3 parts by weight of wax. The mixing was carried out in ethyl alcohol for 4 hr. The resultant slurry was granulated by spray drying. The obtained granular material, which will be called the second material, was about 60 μm in mean grain size and exhibited good fluidity. The granular second material was molded to form the segment 28 of the green plate 12 and the segment 28' of the green plate 14.

To prepare raw materials of mixed ceramics, the granular first material and the granular second material were mixed in selected proportions. That is, the first and second materials were mixed in a V-shaped blender so as to prepare a granular third material in which the proportion of AlN to $Si_3N_4$ was 75:25 by weight, a granular fourth material in which the proportion of AlN to $Si_3N_4$ was 50:50 by weight and a granular fifth material in which the proportion of AlN to $Si_3N_4$ was 25:75 by weight. The third material was moled into the segments 22 and 22' in FIG. 1. The fourth material was molded into the segments 24 and 24; and the fifth material was molded into the segments 26 and 26'.

The green plate 12 was formed by juxtaposing the five segments 20, 22, 24, 26, 26 to each other in the order shown in FIG. 3 and uniting the five segments by press molding. The other green plate 14' was formed in the same way.

The heating resistor 16 was a coiled wire of W (99.99% purity) having a diameter of 0.2 mm. The lead wires 18 were wires of W (99.99% purity) having a diameter of 0.4 mm. The sub-assembly of the heating resistor 16 and the lead wires 18 was placed on the green plate 12 in the manner shown in FIG. 1. Then the green plate 14 was placed on the green plate 12, and the two green plates were united into the green body 10' by application of a pressure higher than the pressure employed in the press molding operation for forming each of the two green plates 12 and 14.

The green body 10' was heated in nitrogen gas at 600° C. for 1 hr to remove the wax (binder) from the green body. After that boron nitride, which was employed as a releasing agent, was applied to the surface of the green body 10', and the green body was sintered in nitrogen gas atmosphere by a hot press sintering method. The applied pressure was 250 kg/cm$^2$, and sintering was accomplished by maintaining a temperature of 1800° C. for 1 hr.

The ceramic body of the sintered ceramic heater 10 was subjected to centerless grinding to round the side surface and expose the terminal portions of the lead wires 18, and the tip end portion of the heating part 10*a* was ground so as to become semispherical. After that external leads (not shown) were connected to the terminal portions of the lead wires 18 to complete the ceramic heater. In the obtained ceramic heater the resistance between the two terminals was 130 milliohms.

It was proved that in the AlN based ceramic which formed the heating part 10*a* of the ceramic body, the amount of the grain boundary phase relatively low in melting temperature was less than 2 vol %. The heat conductivity of the AlN based ceramic was about 170 W/mK. When a voltage of 12 V was applied to the ceramic heater of this example the surface temperature of the heating part 10*a* rose to 900° C. in 1 sec and reached 1500° C. in 15 sec. That is, the rate of rise in the temperature of the heating part 10*a* was fairly high.

Figure 6:
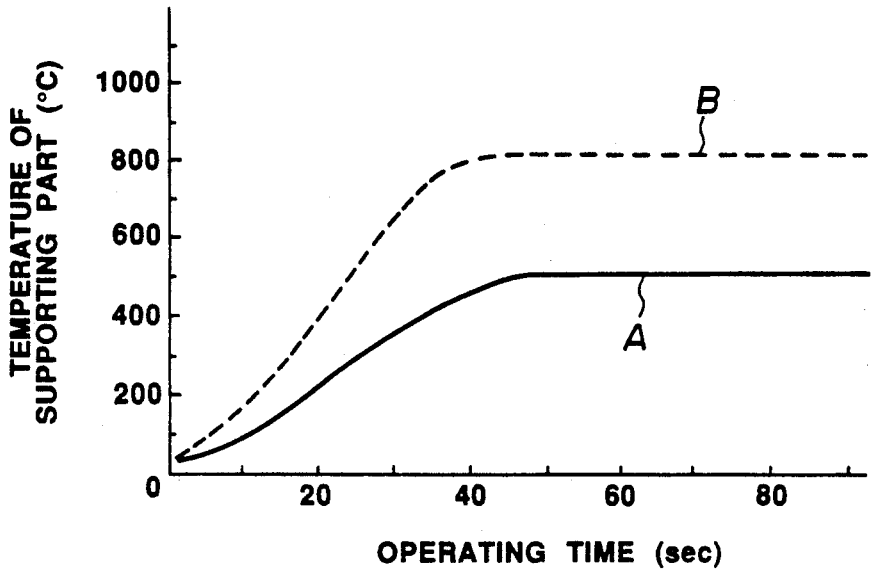
FIG. 6 is a graph showing the rate of a rise in the temperature of the supporting part of the ceramic heater of the first example during operation of the heater by comparison with a conventional ceramic heater.

As a test, the ceramic heater of Example 1 was kept energized so as to keep the surface temperature of the heating part 10*a* constantly at 1300° C., while measuring the temperature of the supporting part 10*b* in a region of the terminal portions of the leads 18. The result is shown in FIG. 6 by the curve A in solid line. As can be seen the temperature of the supporting part 10*b* did not exceed 500° C. Therefore, it is not necessary to forcibly cool the supporting part 10*b* to prevent oxidation and degradation of the soldered connections between the terminals of the leads 18 with external leads. For comparison, a ceramic heater not in accordance with the invention was tested in the same manner. The comparative ceramic heater had the heating resistor (W wire) used in the above Example 1 in a ceramic body entirely formed of the AlN based ceramic employed in Example 1. The test result is shown in FIG. 6 by the curve B in broken line. In this case the temperature of the supporting part (formed of the AlN based ceramic) reached 800° C. in a short time.

Figure 7:
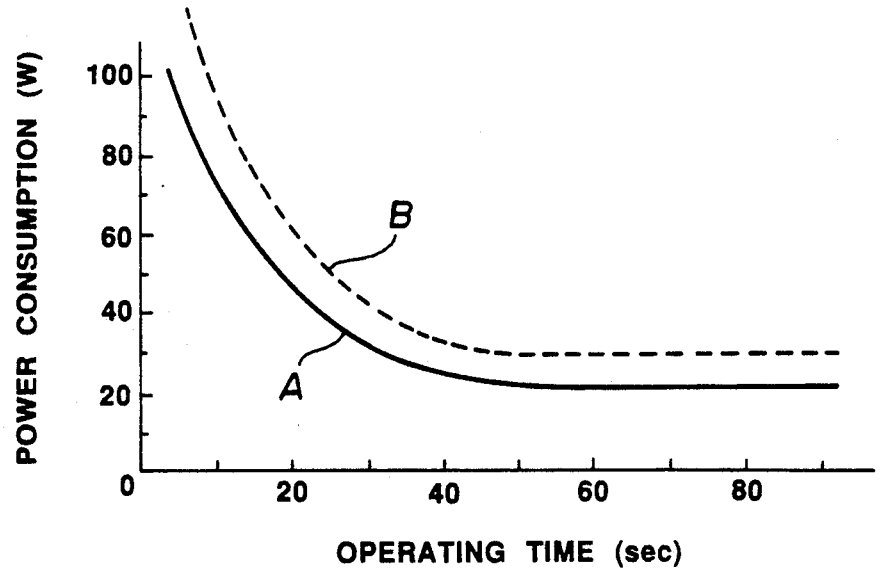
FIG. 7 is a graph showing the manner of a change in the power consumption of the ceramic heater of the first example with the lapse of time by comparison with a conventional ceramic heater.

In another test, the ceramic heater of Example 1 and the aforementioned comparative ceramic heater were kept energized so as to keep the surface temperature of the heating part 10*a* constantly at 1000° C. to measure the power consumption of each ceramic heater in relation to the operating time. The results are shown in FIG. 7, wherein the curve A in solid line represents the ceramic heater of Example 1 and the curve B in broken line the comparative ceramic heater. It is seen that compared with the comparative ceramic heater the ceramic heater of Example 1 was lower in power consumption by about 10 W. In the ceramic heater of Example 1 the supporting part 10*b* was formed of the $Si_3N_4$ based ceramic which was low in heat conductivity (about 17 W/mK), whereby the loss of heat from the supporting part 10*b* decreased.

In the heating part 10*a* of the ceramic heater of Example 1 the thermal expansion coefficient of the AlN based ceramic (about $4.4\times10^6$ in the range from room temperature to 800° C.) is close to the thermal expansion coefficient of tungsten (about $5.05\times10^6$ in the range from room temperature to 800° C.), so that there is little possibility of breakage of the ceramic heater caused by a difference between the heating resistor 16 and the surrounding ceramic in thermal expansion coefficients.

In the ceramic heater of Example 1 the joint part 10*c*, which contained both AlN and $Si_3N_4$ with the above described gradient of the proportion of AlN to $Si_3N_4$, served the purpose of firmly and durably joining the supporting part 10*b* ($Si_3N_4$ based ceramic) with the heating part 10*a* (AlN based ceramic) despite the difference between the two parts 10*b* and 10*a* in thermal expansion coefficients.

Figure 8:
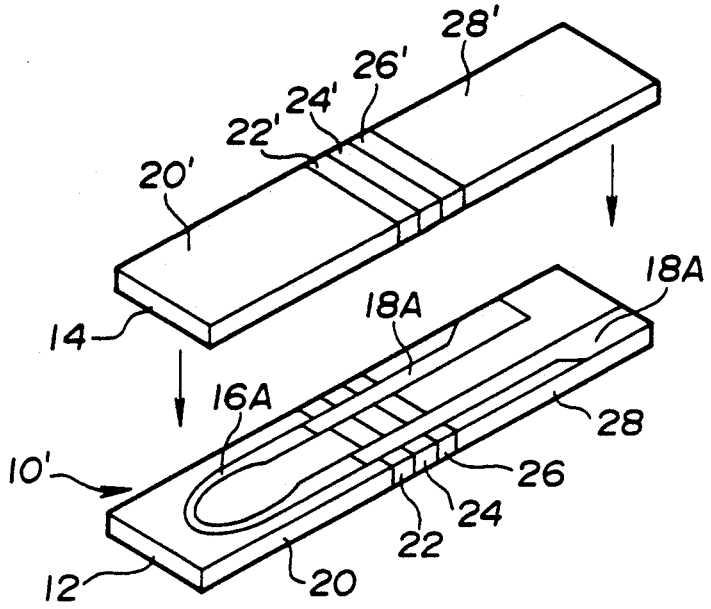
FIG. 8 is an exploded perspective view of a ceramic heater as a second example of the invention in green state before sintering.
Figure 9:
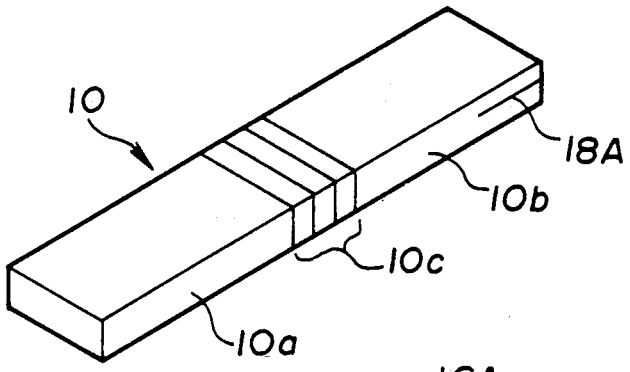
FIG. 9 is a perspective view of the sintered ceramic heater of the second example.

FIGS. 8 and 9 show, as a second embodiment of the invention, a ceramic heater 10 which is assumed to be for use in a fanned kerosene stove as a heater to vaporize kerosene. In principle this ceramic heater is similar to the ceramic heater shown in FIGS. 1 and 2, though the ceramic body of this ceramic heater is in the shape of a cross-sectionally rectangular bar. The ceramic body consists of a heating part 10*a* formed of an AlN based ceramic, a supporting part 10*b* formed of a $Si_3N_4$ based ceramic and a joint part 10*c* formed of mixed ceramics containing both AlN and $Si_3N_4$ with a gradient of the proportion of AlN to $Si_3N_4$.

Figure 10:
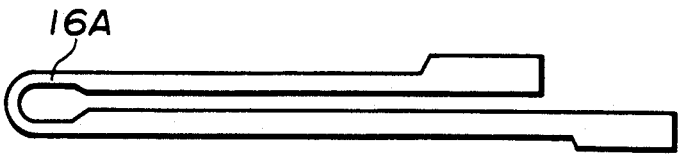
FIG. 10 is a plan view of a printed heating resistor in the ceramic heater of the second example.
Figure 11:
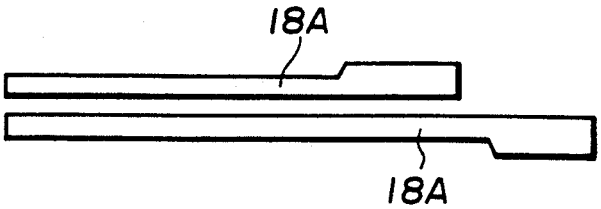
FIG. 11 is a plan view of a pair of printed electrical terminals in the same ceramic heater.
Figure 12:
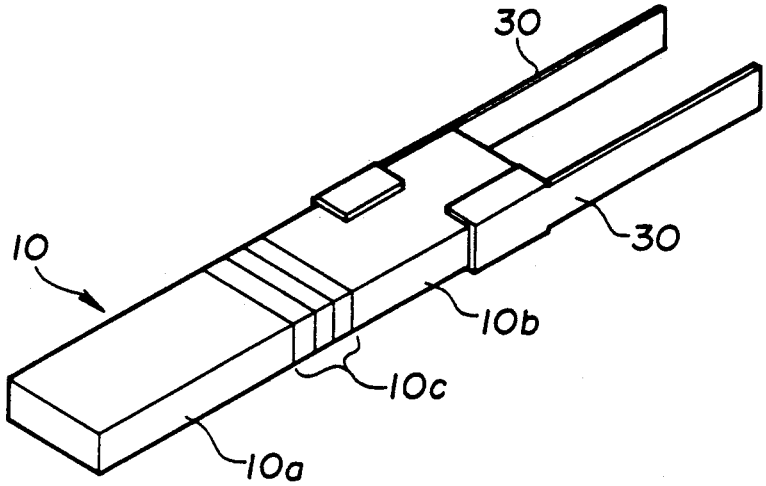
FIG. 12 is a perspective view of the ceramic heater of the second example completed by the attachment of external leads.

As can be seen in FIG. 8 the green body 10' for the ceramic body of the heater is an assembly of two green plates 12 and 14, and each of these green plates 12, 14 is formed by the process described with reference to FIGS. 1 to 4. In this ceramic heater the heating resistor 16A is a film, and the principal material of the heating resistor 16A is WC. Each of the leads 18A is a film of tungsten. The heating resistor 16A is formed by applying a paste containing WC powder to the top surface of the green plate 12 by screen printing. Then the leads 18A are formed by applying a paste containing W powder to the same surface of the green body 12 by screen printing. As shown in FIGS. 10 and 11 by way of example, the heating resistor 16A has elongate extension portions such that the leads 18A can overlie the extension portions of the heating resistor 16A. Consequently good electrical connection is established between the leads 18A and the heating resistor 16A. After the screen printing operations the two green plates 12 and 14 are united by pressing, and the resultant green body 10' is sintered after removing the binder. As shown in FIG. 12, the ceramic heater 10 is completed by attaching external leads 30 to the respective leads 18A by soldering.

EXAMPLE 2

A ceramic heater of the type shown in FIGS. 8 and 9 was produced by the process employed in Example 1 except that the heating resistor 16A and the leads 18A were formed by the following method. The materials of the ceramic body were the same as in Example 1.

To form the heating resistor 16A a paste was prepared by mixing 80 parts by weight of WC powder (99.5% purity; 1.3 μm in mean particle size) and 20 parts by weight of AlN powder (99.9% purity; 1.0 μm in mean particle size) in acetone in which butyl carbitol (employed as a binder) was dissolved so as to adjust the viscosity of the obtained paste to about 800 poise. By screen printing the paste was applied to the green plate 12 so as to form a film having a thickness of about 40 μm in the pattern shown in FIG. 10. To form the leads 18A a paste was prepared by dispersing W powder in a solution of butyl carbitol in acetone, and by screen printing the paste was applied to the extension portions of the heating resistor film (16A) on the green plate 12. When the green body 10' was sintered the conductive films (16A, 18A) in the green body were sintered simultaneously.

EXAMPLE 3

This example is a minor modification of Example 2 only in respect of the materials of the printed heating resistor 16A and the printed leads 18A.

In this example the principal material of the heating resistor 16A was TiN, and the heating resistor 16A was formed by using a paste prepared by mixing 60 parts by weight of TiN powder (99.5% purity; 1.3 μm in mean particle size) and 40 parts by weight of AlN powder (99.9% purity; 1.0 μm in mean particle size) in acetone in which butyl carbitol was dissolved so as to adjust the viscosity of the paste to about 800 poise. By mixing TiN with AlN it is easy to adjust resistivity, and also it is possible to near the thermal expansion coefficient of the heating resistor 16A to that of the AlN based ceramic used as the material of the heating part 10*a* of the ceramic heater body.

The leads 18A were formed by using a paste prepared by mixing 80 parts by weight of WC powder (99% purity; 1 μm in mean particle size) and 20 parts by weight of $Si_3N_4$ powder (above 99% purity; 1.0 μm in mean particle size) in acetone in which butyl carbitol was dissolved so as to adjust the viscosity of the paste to about 800 poise.

In the ceramic heater produced in Example 3 the resistance between the two leads 18A was 125 ohms. When a voltage of 100 V was applied to the heating resistor 16A in this ceramic heater the surface temperature of the heating part 10*a* raised to 800° C. in 5 sec and reached 1300° C. in 40 sec.

EXAMPLE 4

This example is another modification of Example 2. In this example the principal material of the printed heating resistor 16A was TaN. The resistivity of TaN is about 5 times as high as that of TiN.

Figure 13:
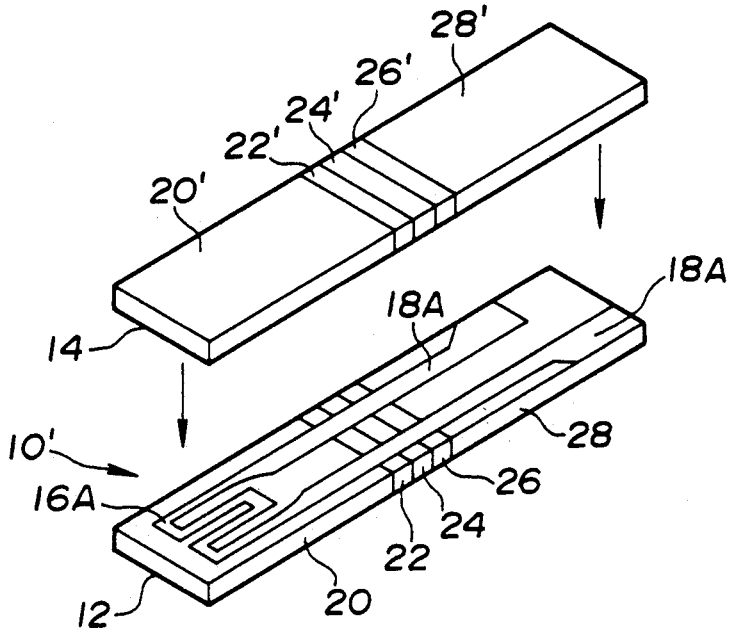
FIG. 13 is an exploded perspective view of a ceramic heater as another example of the invention in green state before sintering.
Figure 14:
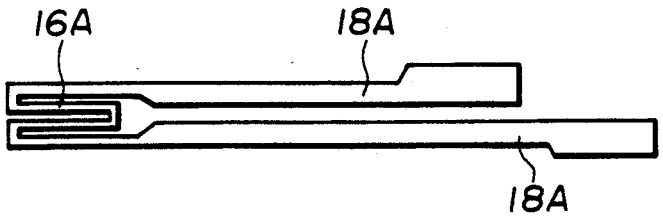
FIG. 14 is a plan view of a printed heating resistor in the ceramic heater shown in FIG. 13.

As shown in FIGS. 13 and 14, the heating resistor 16A in this example was formed in a meandering or repeatedly turning pattern. The extended terminal portions of the heating resistor 18A were made broader in width in order to reduce resistance, and these portions were used as leads without overlaying these portions with another conductive material.

The heating resistor 16A was formed by using a paste prepared by mixing 80 parts by weight of TaN powder (99.5% purity; 1.0 μm in mean particle size) and 20 parts by weight of AlN powder (99.9% purity; 1.0 μm in mean particle size) in acetone in which butyl carbitol was dissolved so as to adjust the viscosity of the paste to about 800 poise.

Figure 15:
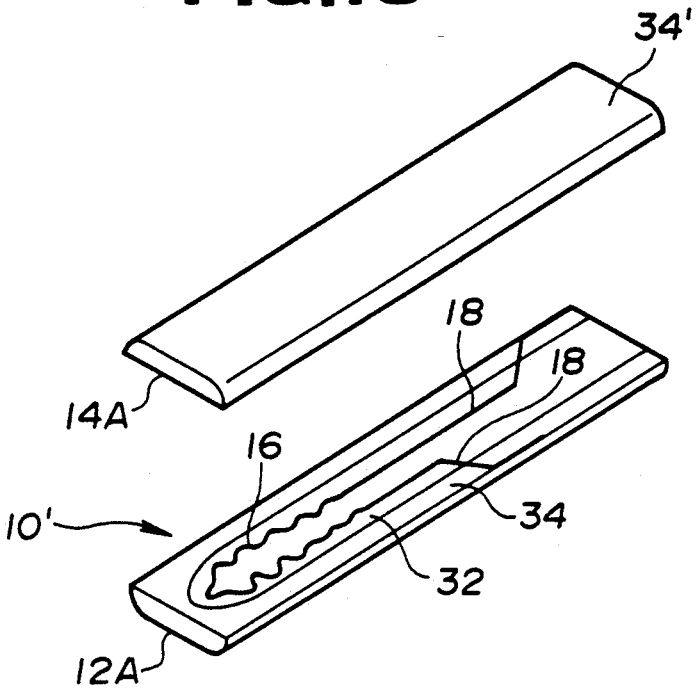
FIG. 15 is an exploded perspective view of a ceramic heater as a third example of the invention in green state before sintering.
Figure 16:
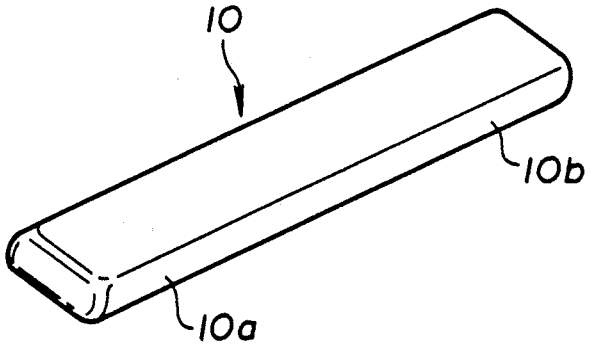
FIG. 16 is a perspective view of the sintered ceramic heater of the third example.

FIGS. 15 and 16 show another ceramic heater 10 as a still different embodiment of the invention. As shown in FIG. 15 the green body 10' for this ceramic heater 10 is an assembly of two green plates 12A and 14A. The heating resistor 16, which is made of a wire of tungsten or a tungsten alloy, and the lead wires 18 are arranged on the top surface of the green part 12A. Then the opposite green plate 14A is placed on the green plate 12A, and the two green plates 12A, 14A are united by pressing.

In the green plate 12A a central region 32 is formed of an AlN based ceramic material, and the remaining outer region 34 is formed of a $Si_3N_4$ based ceramic material. The central region 32 is designed such that the heating resistor 16 can be disposed on the surface of this region 32 without making contact with the $Si_3N_4$ based ceramic material of the outer region 34. In the opposite green plate 14A too, a central region (not shown in FIG. 15) is formed of the AlN based ceramic material, and the remaining outer region 34' is formed of the $Si_3N_4$ based ceramic material. Therefore, in the ceramic heater 10 obtained by sintering the green body 10' of FIG. 15 only a core region of the ceramic body is formed of the AlN based ceramic, and the heating resistor 16 is embedded in this core region. The remaining, cross-sectionally outer region is formed of the $Si_3N_4$ based ceramic. Although the core region of the AlN based ceramic extends over nearly the whole length of the ceramic body, the heating resistor 16 is arranged within a limited length from one end of the ceramic body. Therefore, a forward part of the elongate ceramic body confining therein the heating resistor 16 serves as a heating part 10*a*, and the remaining rear part serves as a supporting part 10*b*.

EXAMPLE 5

A ceramic heater of the type shown in FIGS. 15 and 16 was produced by modifying the process in Example 1 in the following respects.

Figure 17:
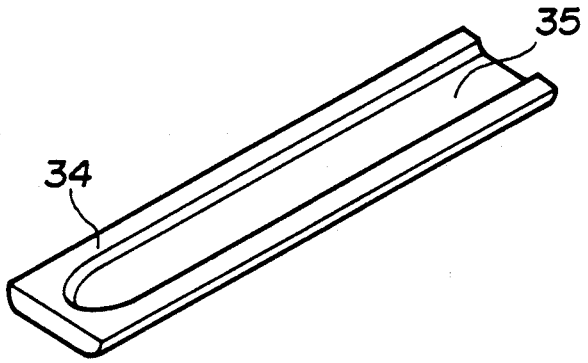
FIG. 17 is a perspective view of a half of the green body shown in FIG. 15 in an unfinished state.
Figure 18:
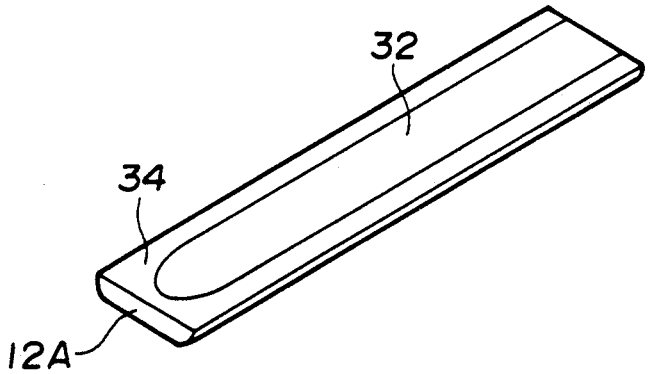
FIG. 18 is a perspective view of the same half of the green body in a state just before printing the heating resistor and terminals thereon.

To obtain the green plate 12A shown in FIG. 15, the granular second material ($Si_3N_4$ based ceramic material) prepared in Example 1 was molded into a green part 34 shown in FIG. 17. This green part 34 is a plate having a relatively wide groove 35. Next, the groove 35 was filled with the granular first material (AlN based ceramic material) prepared in Example 1, and the green part 34 and the first material in the groove 35 were united by press molding. As shown in FIG. 18, the obtained green plate 12A had a central region 32 formed of the AlN based ceramic material and an outer region 34 formed of the $Si_3N_4$ based ceramic material. The opposite green plate 14A was prepared by the same process. The heating resistor 16 and the lead wires 18 were placed on the green plate 12A. After that assembling of the green plates 12A and 14A into the green body 10' and sintering of the green body were performed in the same manner as in Example 1.

The ceramic heater shown in FIGS. 15 and 16 is very high in transverse strength both at room temperature and at high temperatures since a core of AlN based ceramic is tightly sheathed by $Si_3N_4$ based ceramic. By the three-point flexural testing method with a span of 20 mm, the bending strength of this ceramic heater was 90 $kg/mm^2$ at room temperature and 75 $kg/mm^2$ at 1200° C. The tested ceramic heaters were 3.5 mm in outer diameter and 37 mm in length. For comparison, another ceramic heater of the same type and same dimensions was produced by using only the AlN based ceramic to form the entirety of the ceramic body. The bending strength of the comparative ceramic heater was 35 $kg/mm^2$ at room temperature and 30 $kg/mm^2$ at 1200° C.

As to the heating resistor 16 in the ceramic heater shown in FIGS. 15 and 16, it is possible to employ a film formed by a printing method instead of the illustrated wire.

As an optional modification of the ceramic heater shown in FIGS. 13 and 14 the supporting part 10*b* may entirely be formed of $Si_3N_4$ based ceramic by reducing the length of the core region (32) of AlN based ceramic. As another optional modification modification, both the core and surface regions of the heating part 10*a* of the ceramic body may be formed of AlN based ceramic without covering with $Si_3N_4$ based ceramic or with only partial covering with $Si_3N_4$ based ceramic. It is also possible to interpose a joint part (not shown), which is formed of mixed ceramics containing both AlN and $Si_3N_4$ with a gradient of the proportion of AlN to $Si_3N_4$, between the core region (32) of AlN based ceramic and the outer region (34) of $Si_3N_4$ based ceramic.

In any of the above described embodiments or examples of the invention it is optional to coat the surface of the ceramic body with a corrosion resistant material such as, for example, SiC or β-sialon to further enhance the durability of the ceramic heater.

What is claimed is:

1. A ceramic heater having a sintered nonoxide ceramic body, which has a heating part and a supporting part, and a heating resistor which is embedded in the heating part of the ceramic body, characterized in that said heating part of said ceramic body is formed of an aluminum nitride based ceramic at least in a core region thereof which is in contact with and encloses said heating element, and that said supporting part is formed of a silicon nitride based ceramic at least in a surface region thereof.

2. A ceramic heater according to claim 1, wherein the principal material of said heating resistor is selected from the group consisting of elemental tungsten, tungsten carbide (WC) and tungsten alloys.

3. A ceramic heater according to claim 1, wherein the principal material of said heating resistor is a metal nitride.

4. A ceramic heater according to claim 3, wherein said metal nitride is selected from the group consisting of TiN and TaN.

5. A ceramic heater having a sintered nonoxide ceramic body, which has a heating part and a supporting part, and a heating resistor which is embedded in the heating part of the ceramic body, characterized in that said heating part of said ceramic body is formed of an aluminum nitride based ceramic at least in a core region thereof which is in contact with and encloses said heating element, and that said supporting part is formed of a silicon nitride based ceramic at least in a surface region thereof, and wherein said ceramic body has a joint part which is interposed between said heating part and said supporting part and is formed of a mixed ceramic containing both aluminum nitride and silicon nitride with a gradient of the proportion of aluminum nitride to silicon nitride such that said proportion becomes maximal in one end region of the joint part adjacent to said heating part and minimal in the opposite end region adjacent to said supporting part.

6. A ceramic heater according to claim 1, wherein said ceramic body has an elongate shape, said heating part being contiguous to one end of the elongate ceramic body and substantially entirely formed of said aluminum nitride based ceramic, said supporting part being contiguous to the opposite end of the elongate ceramic body and substantially entirely formed of said silicon nitride based ceramic.

7. A ceramic heater having a sintered nonoxide ceramic body, which has a heating part and a supporting part, and a heating resistor which is embedded in the heating part of the ceramic body, characterized in that said heating part of said ceramic body is formed of an aluminum nitride based ceramic at least in a core region thereof which is in contact with and encloses said heating element, and that said supporting part is formed of a silicon nitride based ceramic at least in a surface region thereof, and wherein:

said ceramic body has an elongate shape, said heating part being contiguous to one end of the elongate ceramic body and substantially entirely formed of said aluminum nitride based ceramic, said supporting part being contiguous to the opposite end of the elongate ceramic body and substantially entirely formed of said silicon nitride based ceramic; and said elongate ceramic body has a joint part which is interposed between said heating part and said supporting part and is formed of a mixed ceramic containing both aluminum nitride and silicon nitride with a gradient of the proportion of aluminum nitride to silicon nitride such that said proportion becomes maximal in one end region of the joint part adjacent to said heating part and minimal in the opposite end region of the joint part adjacent to said supporting part.

8. A ceramic heater according to claim 7, wherein said joint part consists of a plurality of segments which are different from each other in the proportion of aluminum nitride to silicon nitride, in each of said plurality of segments the proportion of aluminum nitride to silicon nitride being substantially uniform.

9. A ceramic heater according to claim 1, wherein said heating part of said ceramic body has a covering region which encloses said core region and is formed of said silicon nitride based ceramic.

10. A ceramic heater according to claim 1, wherein said supporting part of said ceramic body has a core region which is covered by said surface region, contiguous to said core region of said heating part and formed of said aluminum nitride based ceramic.

11. A ceramic heater according to claim 10, wherein said ceramic body has an elongate shape, said heating part being contiguous to one end of the elongate ceramic body, said supporting part being contiguous to the opposite end of the elongate ceramic body.

12. A ceramic heater according to claim 1, wherein said heating resistor is made of a wire.

13. A ceramic heater according to claim 1, wherein said heating resistor is made of a film.

14. A ceramic heater according to claim 13, wherein said heating resistor is formed by a thick-film printing process using a paste containing a powder of the material of the heating resistor.

15. A ceramic heater according to claim 5, wherein the principal material of said heating resistor is selected from the group consisting of elemental tungsten, tungsten carbide (WC) and tungsten alloys.

16. A ceramic heater according to claim 5, wherein the principal material of said heating resistor is a metal nitride.

17. A ceramic heater according to claim 16, wherein said metal nitride is selected from the group consisting of TiN and TaN.

18. A ceramic heater according to claim 5, wherein said heating resistor is made of a wire.

19. A ceramic heater according to claim 5, wherein said heating resistor is made of a film.

20. A ceramic heater according to claim 19, wherein said heating resistor is formed by a thick-film printing process using a paste containing a powder of the material to the heating resistor.

21. A ceramic heater according to claim 7, wherein the principal material of said heating resistor is selected from the group consisting of elemental tungsten, tungsten carbide (WC) and tungsten alloys.

22. A ceramic heater according to claim 7, wherein the principal material of said heating resistor is a metal nitride.

23. A ceramic heater according to claim 22, wherein said metal nitride is selected from the group consisting of TiN and TaN.

24. A ceramic heater according to claim 7, wherein said heating resistor is made of a wire.

25. A ceramic heater according to claim 7, wherein said heating resistor is made of a film.

26. A ceramic heater according to claim 25, wherein said heating resistor is formed by a thick-film printing process using a paste containing a powder of the material to the heating resistor.

27. A ceramic heater according to claim 1, wherein said heating part of said ceramic body is formed of an aluminum nitride based ceramic comprising 100 parts by weight AlN, 1 part by weight $Y_2O_3$ and 3 parts by weight of wax.

* * * * *